US010624507B1

(12) United States Patent
Breeze, Jr.

(10) Patent No.: US 10,624,507 B1
(45) Date of Patent: Apr. 21, 2020

(54) CAT-PROOF TOILET PAPER DISPENSER

(71) Applicant: Bobby Gene Breeze, Jr., Austin, TX (US)

(72) Inventor: Bobby Gene Breeze, Jr., Austin, TX (US)

( * ) Notice: Subject to any disclaimer, the term of this patent is extended or adjusted under 35 U.S.C. 154(b) by 0 days.

(21) Appl. No.: 16/246,527

(22) Filed: Jan. 13, 2019

(51) Int. Cl.
*A47K 10/22* (2006.01)
*A47K 10/40* (2006.01)
*A47K 10/38* (2006.01)

(52) U.S. Cl.
CPC ..... *A47K 10/40* (2013.01); *A47K 10/22* (2013.01); *A47K 10/3809* (2013.01)

(58) Field of Classification Search
CPC ..... A47K 10/22; A47K 10/32; A47K 10/34; A47K 10/38; A47K 10/3809; A47K 10/40; A47K 10/405; A47K 10/42; A47K 10/426; A47K 10/427; A47K 2010/3233; A47K 2010/3246
USPC ..... 242/590, 598, 601
See application file for complete search history.

(56) References Cited

U.S. PATENT DOCUMENTS 5,261,557 A * 11/1993 Bytell ..... A47K 10/34 220/662
6,848,349 B2 * 2/2005 Tramontina ..... A47K 10/38 225/72
7,185,843 B1 * 3/2007 Li ..... A47K 10/40 242/560
10,016,099 B2 * 7/2018 Cittadino ..... B65H 23/06
2012/0305587 A1 * 12/2012 Williford ..... A47K 10/42 221/46
2014/0034664 A1 * 2/2014 Biro ..... A47K 10/424 221/33
2016/0340138 A1 * 11/2016 Ryan ..... A47K 10/3827
2017/0112335 A1 * 4/2017 Diamond ..... A47K 10/3687
2017/0215659 A1 * 8/2017 Jefferson ..... A47K 10/36
2017/0354984 A1 * 12/2017 Beal ..... B05B 12/122
2018/0353017 A1 * 12/2018 Miranda ..... A47K 10/22
2019/0290078 A1 * 9/2019 Moses ..... A47K 10/38

FOREIGN PATENT DOCUMENTS

FR 2070568 A5 * 9/1971 ..... A47K 10/40

* cited by examiner

*Primary Examiner* — Joshua E Rodden

(57) ABSTRACT

A dispenser which holds a single roll of toilet paper while also providing protection against damage or unrolling of the toilet paper roll by cats. A housing is composed of both a front and back portion connected by two hinges on the top surfaces. Both portions consist of a top, bottom, left and right sides. The front portion also has a partial front face. This front portion has a removable panel that is attached by four fasteners which can be customized with graphics and/or wording and which can be viewed whether the front portion is open or closed. The rear portion also has a partial rear side with four holes in it that are utilized for four fasteners to be used to mount the invention to a vertical surface. When closed, this dispenser provides full enclosure of the toilet paper roll which is supported by an internal spindle.

5 Claims, 8 Drawing Sheets

CAT-PROOF TOILET PAPER DISPENSER

TECHNICAL FIELD

The present invention relates to toilet paper dispensers and more particularly pertains to a new toilet paper dispenser that provides protection from damage and/or unwinding by cats.

CLASSIFICATIONS

A47K 10/38 Dispensers for paper towels or toilet-paper dispensing from a web, e.g. with mechanical dispensing means the web being rolled up with or without tearing edge.

BACKGROUND—PRIOR ART

The use of toilet paper dispensers is known in the prior art. More specifically, toilet paper dispensers/holders heretofore devised and utilized are known to consist basically of familiar, expected and obvious structural configurations, notwithstanding the myriad of designs encompassed by the crowded prior art which have been developed for the fulfillment of countless objectives and requirements.
The following is a tabulation of some prior art that presently appears relevant:

| U.S. Patents | | | |
|---|---|---|---|
| Pat. No. | Kind Code | Issue Date | Patentee |
| 2,440,974 | A | Aug. 24, 1945 | Resch |
| 2,462,776 | A | Apr. 13, 1945 | Price |
| 2,555,885 | A | Mar. 12, 1948 | Hope |
| 3,729,145 | A | Dec. 29, 1971 | Hyup, Gul |
| 4,089,481 | A | Nov. 26, 1976 | Ciuci |
| 4,467,974 | A | Feb. 14, 1983 | Crim |
| 4,659,028 | A | May 16, 1985 | Wren |
| 4,721,264 | A | Jun. 15, 1987 | Muscarello |
| 5,170,958 | A | Sep. 25, 1989 | Brown |
| 5,409,181 | A | Jul. 26, 1993 | Patrick |
| 5,697,577 | A | Feb. 27, 1996 | Ogden |
| 5,868,275 | A | Oct. 31, 1995 | Moody |
| 6,382,552 | B1 | May 24, 2000 | Williams |
| 6,476,365 | B1 | Jun. 8, 2001 | Rios |

SPECIFIC PROBLEMS WITH PRIOR ART

While these devices fulfill their respective, particular objectives and requirements, the aforementioned patents do not disclose a new toilet paper dispenser/holder.

Most traditional toilet paper dispensers/holders are meant to just dispense and/or hold a single roll of toilet paper and to dispense it conveniently and to provide an easy means of roll replacement, once the roll is empty. Of all the prior art examples provided above, none of them provide a totally sealed enclosure for the toilet paper that will keep the toilet paper roll out of sight and in a safe location that cats cannot access when closed and which also provides an easy means of use as well as ease of changing out the empty roll when the door is open.

None of the prior art examples provide a warning statement, when the door is open, stating that the unit is not cat-proof when the door is open.

None of the prior art examples feature a removable front face plate that can be customized with graphics and/or text.

None of the prior an examples appear to be easily made by either 3D printing or using injection molding technology.

Muscarello's dispenser was designed to be "child proof" but this design is very cumbersome; and does not provide full protection from damage and/or unwinding by cats.

Price's, Hope's, Gul/Hyup's, Ciuci's, Crim's, Muscarello's, Ogden's, Paul/Williams' and Rios' dispensers do not provide a flat surface on top of the unit as a convenient location to set small objects, such as a cellular telephone.

In view of the foregoing disadvantages inherent in the known types of toilet paper dispensers now present in the prior art, the present invention provides a new toilet paper dispenser construction wherein the same can be utilized for dispensing/holding toilet paper and providing protection of the toilet paper from damage and/or unwinding by cats when the front portion is in the down/closed position while at the same time providing a convenient surface to place small objects. When in the open position, the door provides a warning statement to the user that the unit is not cat-proof when the door is open.

SUMMARY

The general purpose of the present invention, which will be described subsequently in greater detail, is to provide a new toilet paper dispenser apparatus and method which has many of the advantages of the toilet paper dispensers/holders mentioned heretofore and many novel features that result in a new toilet paper dispenser which is not anticipated, rendered obvious, suggested, or even implied by any of the prior art toilet paper dispensers, either alone or in any combination thereof.

To attain this, the present invention generally comprises a roll of toilet paper in a housing unit. The toilet paper has sufficient strength to be selectively unrolled. A housing has a front door component and a back base component. Each of the front and back components has a first side wall, a second side wall, a top wall and a bottom wall. The top walls are pivotally coupled together by two hinges. This coupling allows the front door component to be rotated upwards 180 degrees from the down/closed position to the up/open position. Four screws penetrate through four holes, with one in each corner of the partial back wall of the back base component support the housing on the vertical wall. Each of the screws is located in a corner of the partial back wall of the rear base component and each is attached to the vertical wall. A spindle is removably extended into two chamfered pockets which are located in each of the side walls of the back base component. The spindle extends through the roll of toilet paper. The front door component has a panel, which is attached by four screws, that can be customized with wording or graphics and can be removed and replaced. This panel can be seen through a square window in the front wall of the front door component. While the front door component is in the open position, the preferred wording, which consists of a warning statement relays to the user that the dispenser is not cat-proof when the door is open. This statement can be seen by the user only when the front door component is in the up/open position. The front door component has two soft rubber bumpers located in the lower corners which touch the back portion that soften the impact when the front portion is closed. The front door component is attached to the rear base component by two hinges. Each hinge is attached to the front door component and the rear base component by a total of eight fasteners. Each fastener is a flush screw and flush self-locking nut. Each of these self-locking nuts are countersunk into the front door and rear base components to eliminate the possibility of snagging the toilet paper during the dispensing process. The front door component, the rear base component, and the removable door panel are manufactured using 3D printing methods but can also be fabricated using injection molded plastic methods.

There has thus been outlined, rather broadly, the more important features of the invention in order that the detailed description thereof that follows may be better understood, and in order that the present contribution to the art may be better appreciated. There are additional features of the invention that will be described hereinafter, and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing summary is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The summary is neither intended to define the invention of the application, which is measured by the claims, nor is it intended to be limiting as to the scope of the invention in any way.

DESCRIPTION OF THE DRAWINGS

The invention will be better understood and objects other than those set forth above will become apparent when consideration is given to the following detailed description thereof. Such description refers to the annexed drawings wherein.

DRAWINGS—REFERENCE NUMERALS

Reference Numeral Description

Figure 1:
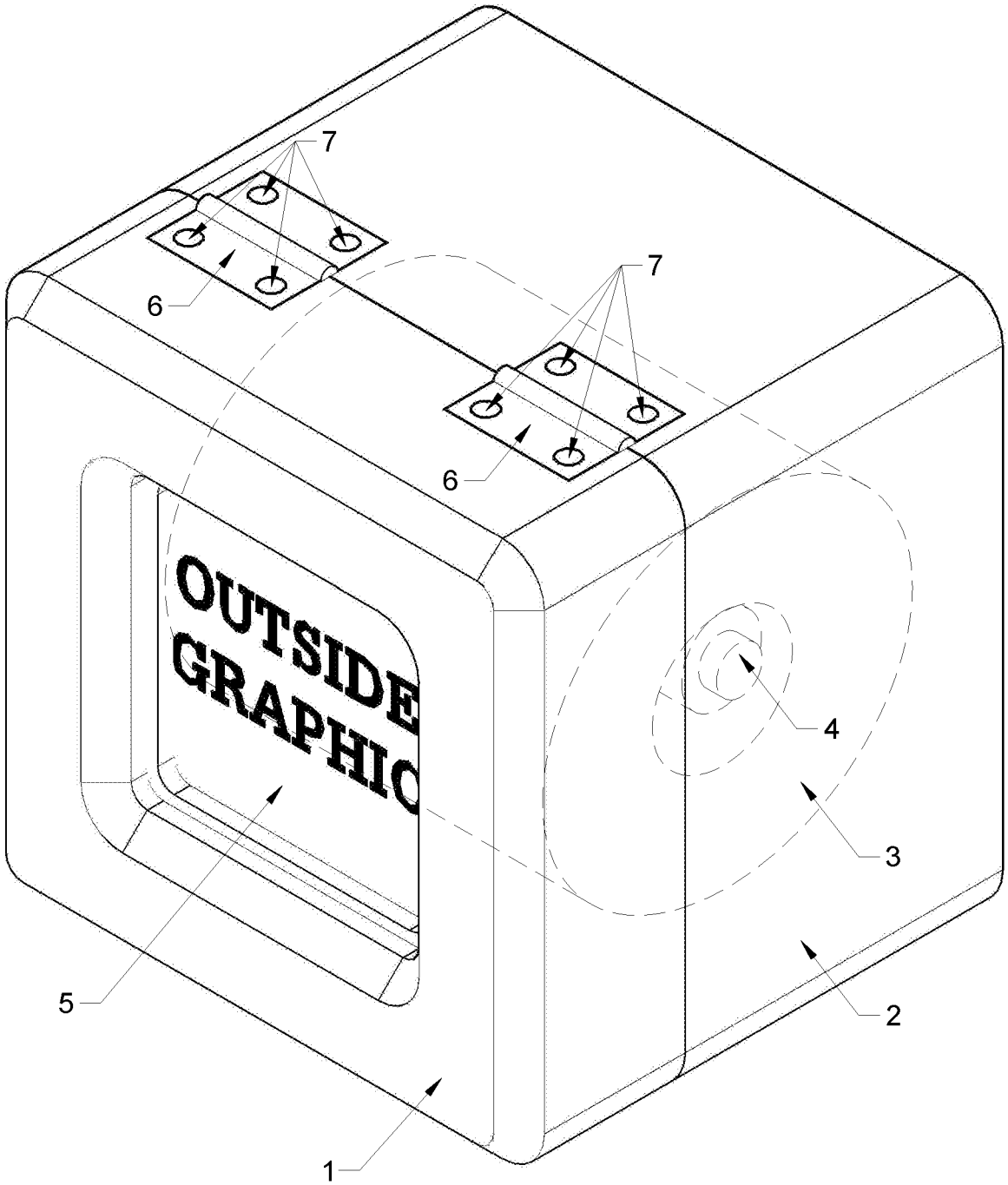
FIG. 1 is an upper front right perspective view of a new toilet paper dispenser according to the present invention with the front door component closed.
Figure 2:
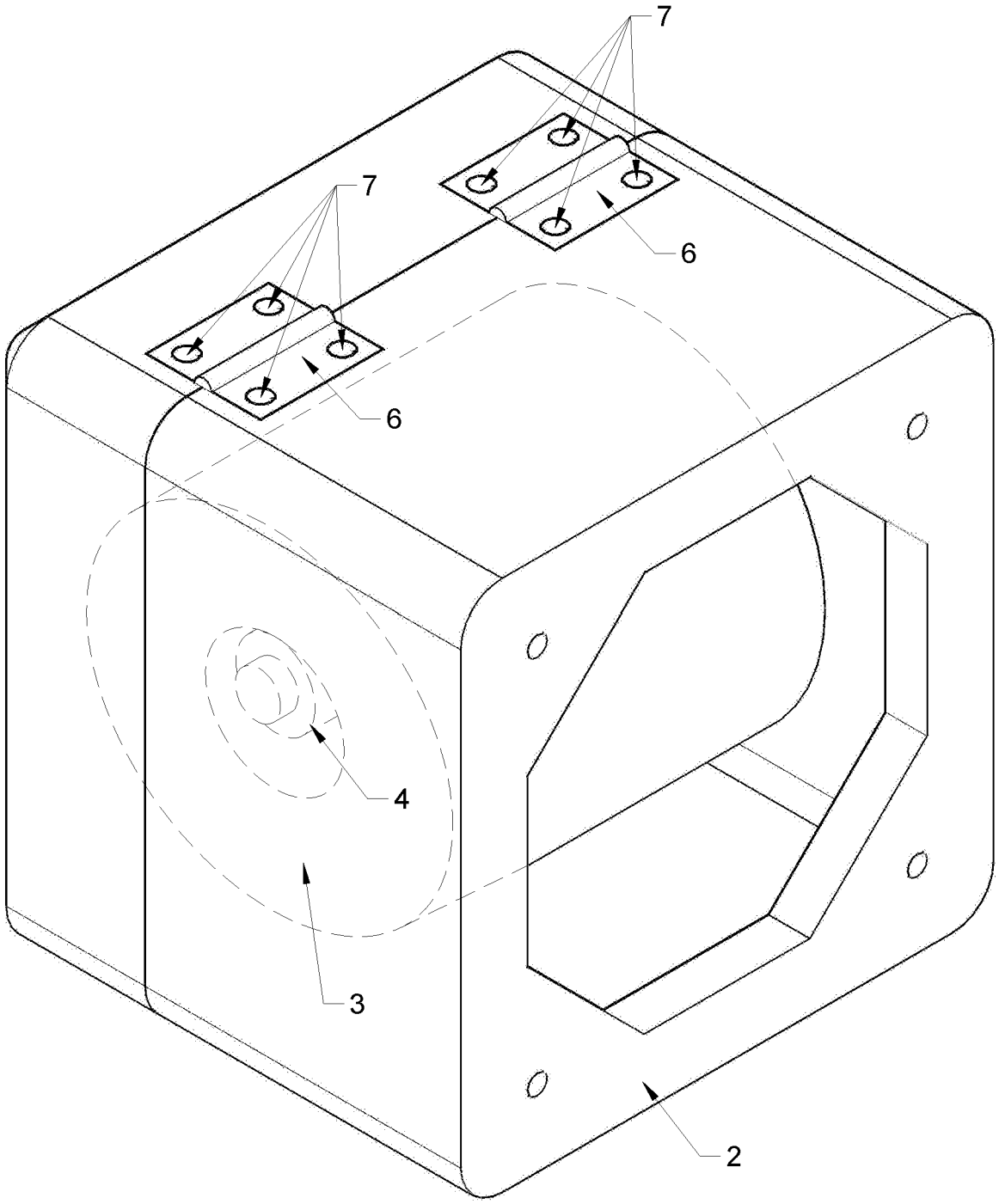
FIG. 2 is an upper right rear perspective view of the present invention.
Figure 3:
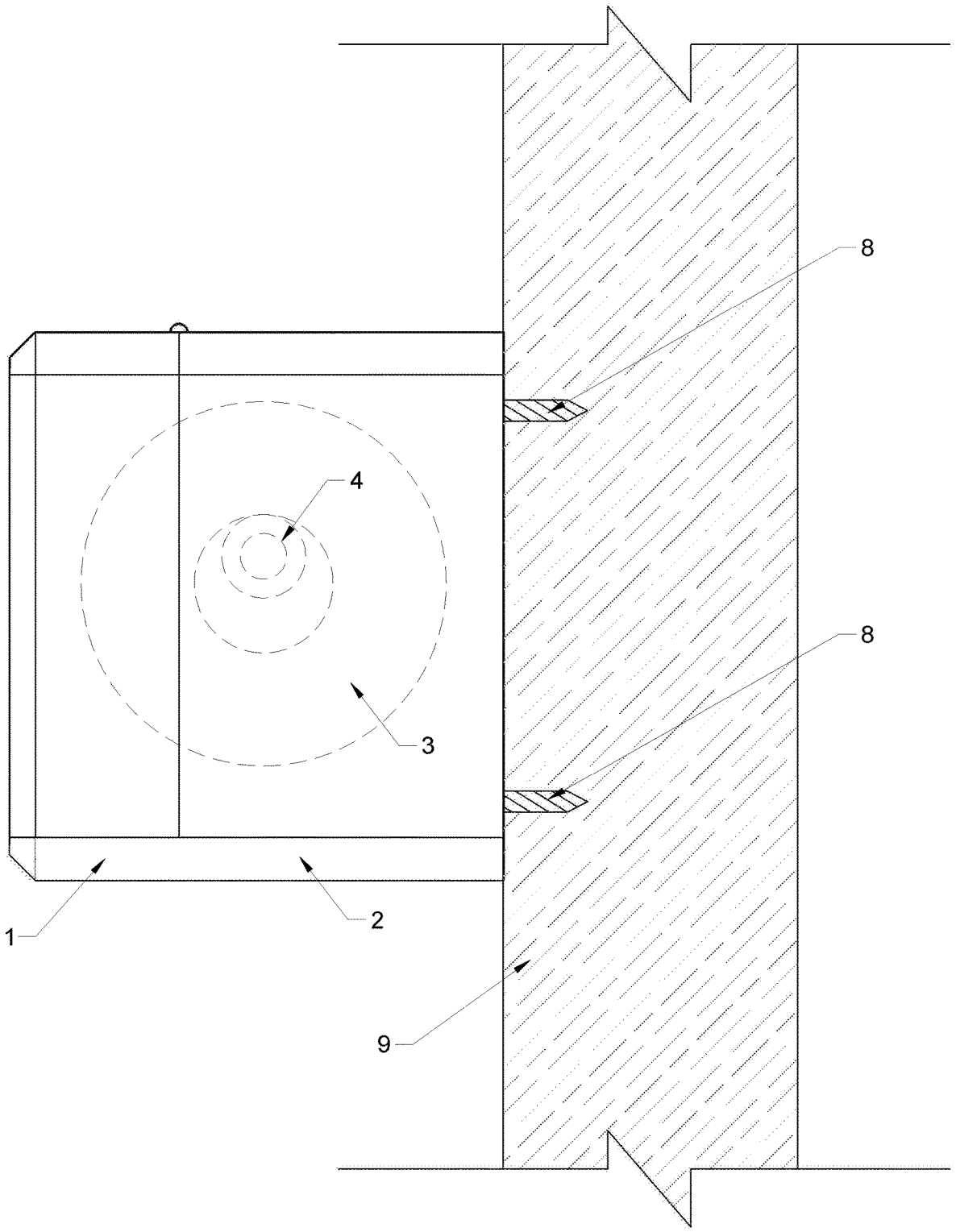
FIG. 3 is a right side view of the present invention.
Figure 4:
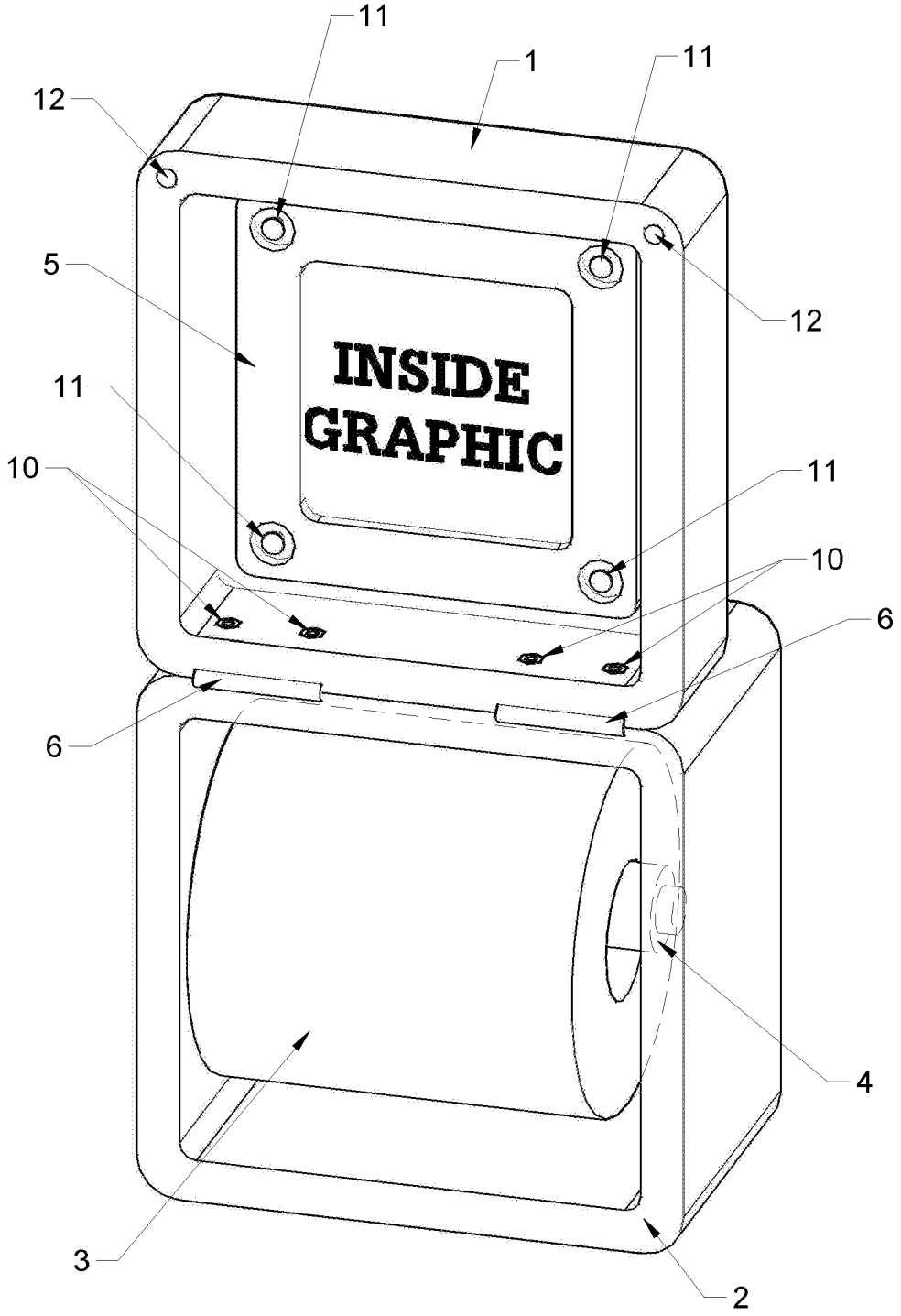
FIG. 4 is an upper right front perspective view of the present invention with the front door component opened.
Figure 5:
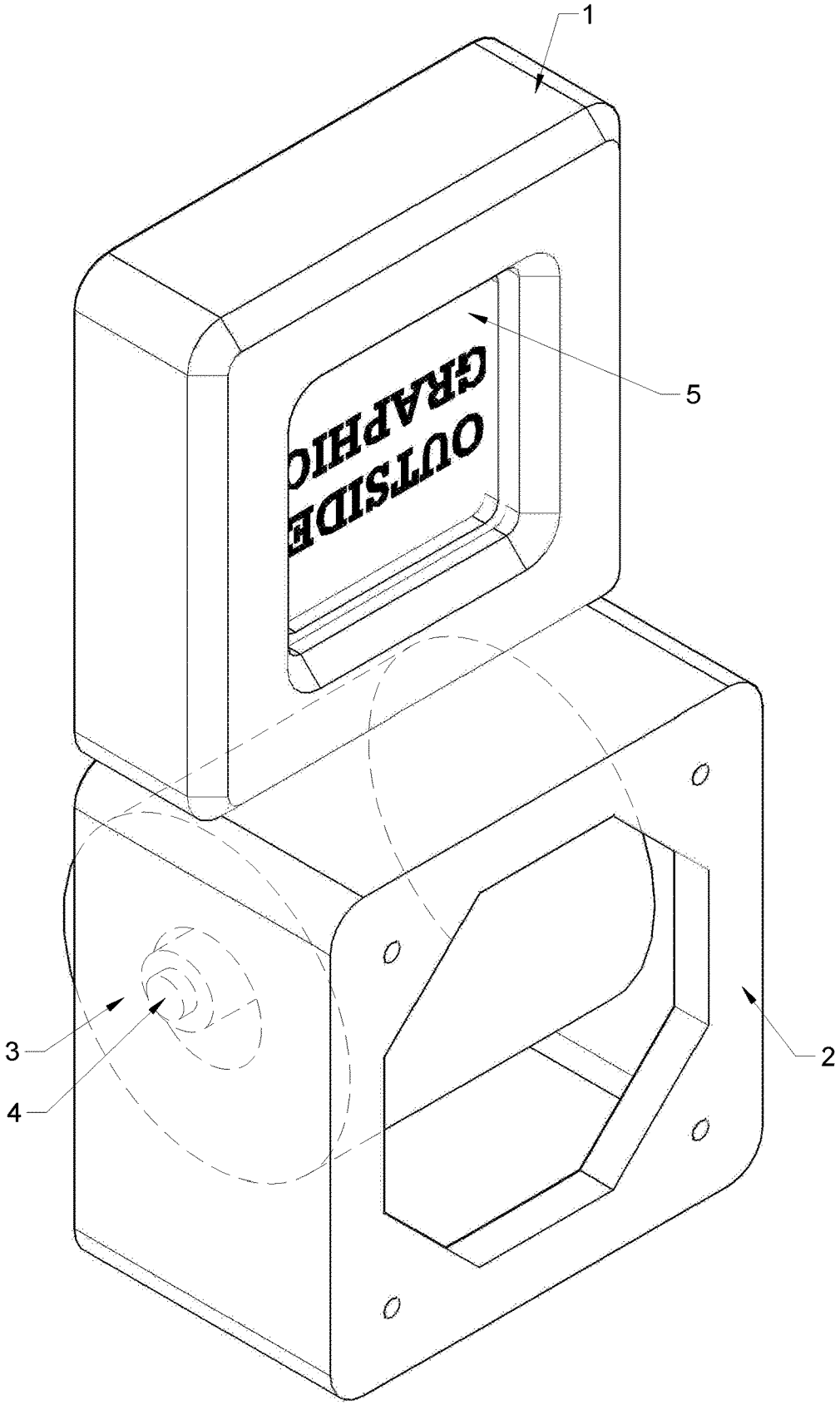
FIG. 5 is an upper right rear perspective view of the present invention with the front door component opened.
Figure 6:
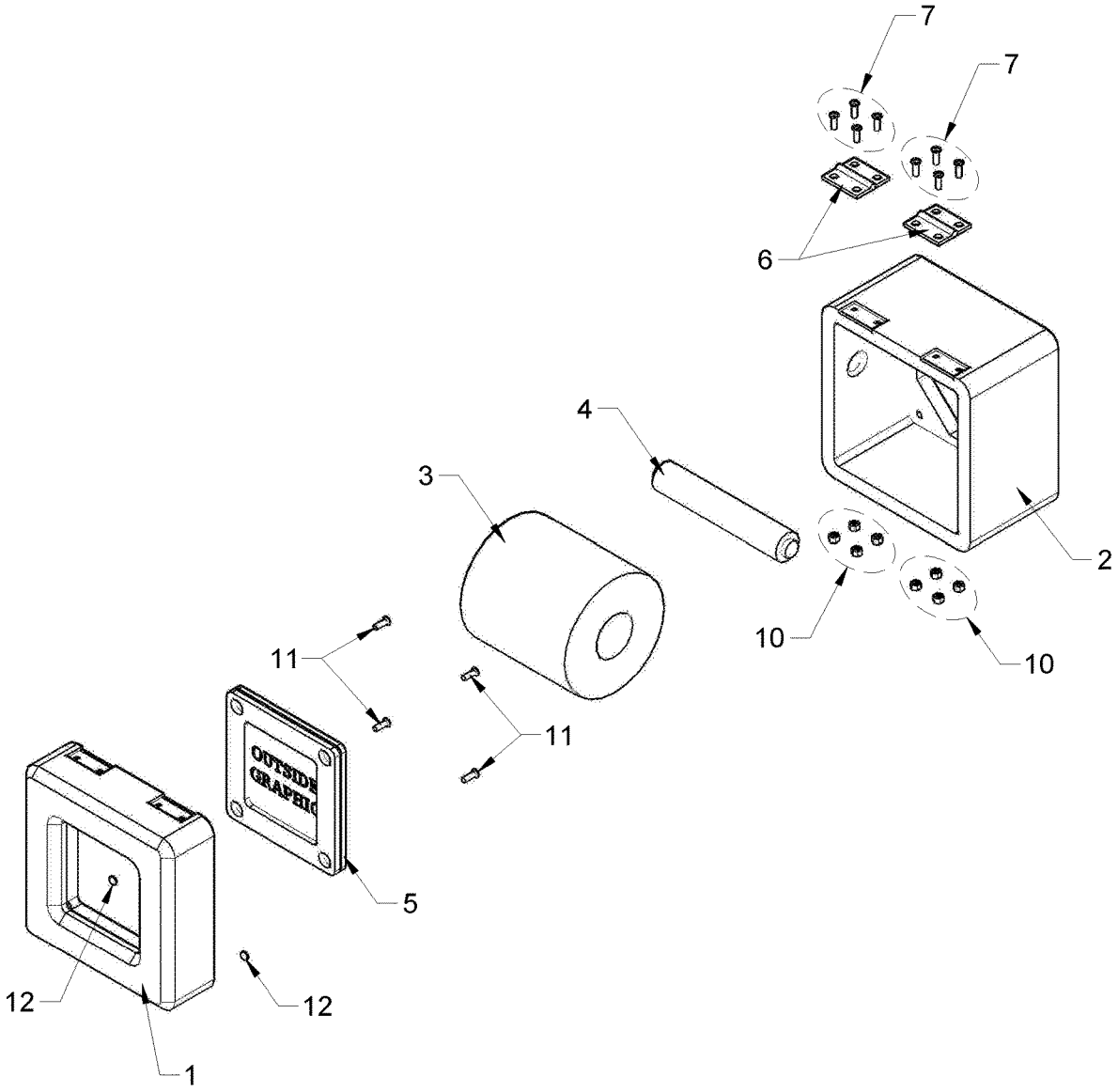
FIG. 6 is an upper right front perspective view of the exploded invention.
Figure 7:
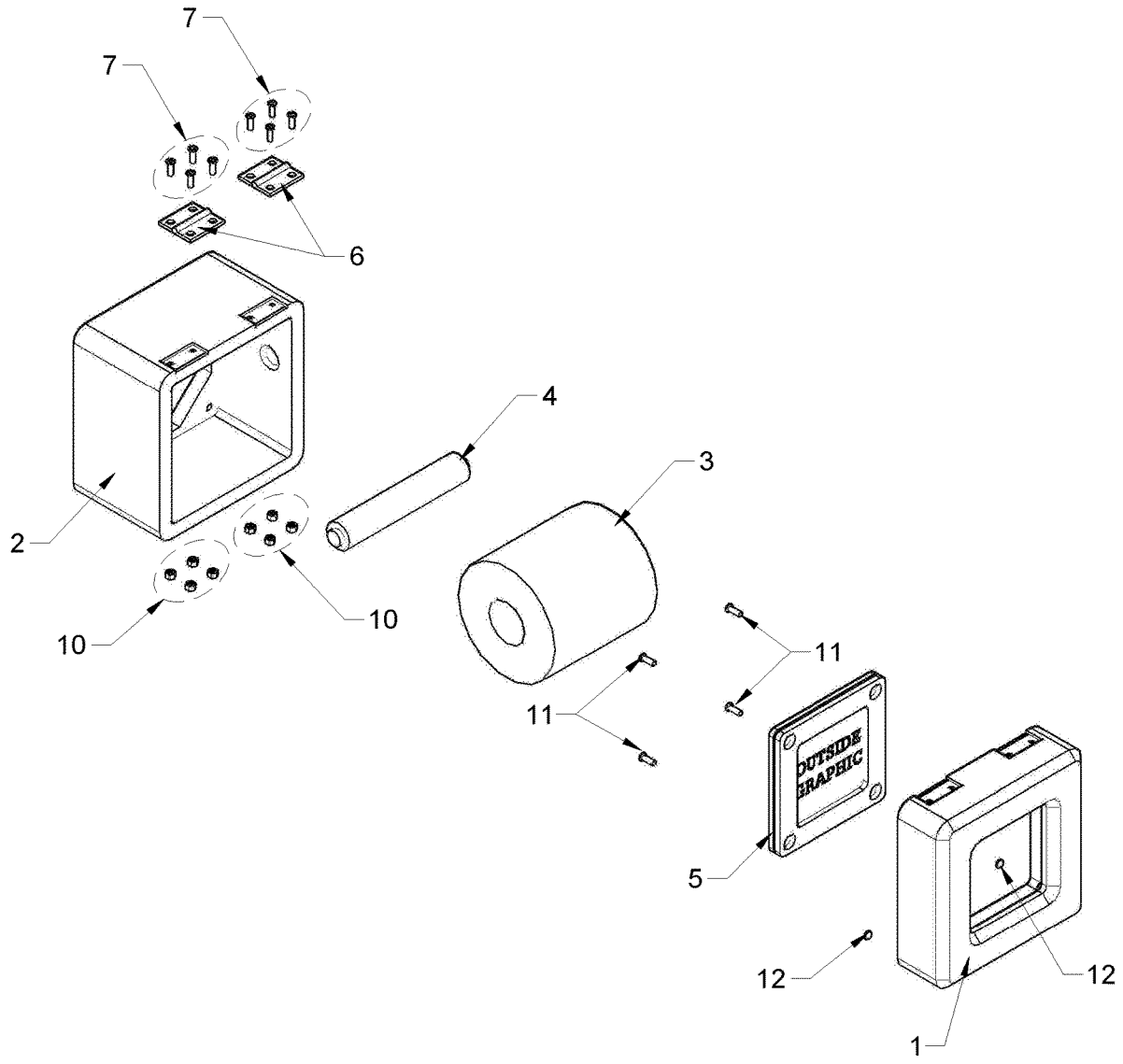
FIG. 7 is an upper left front perspective view of the exploded invention.
Figure 8:
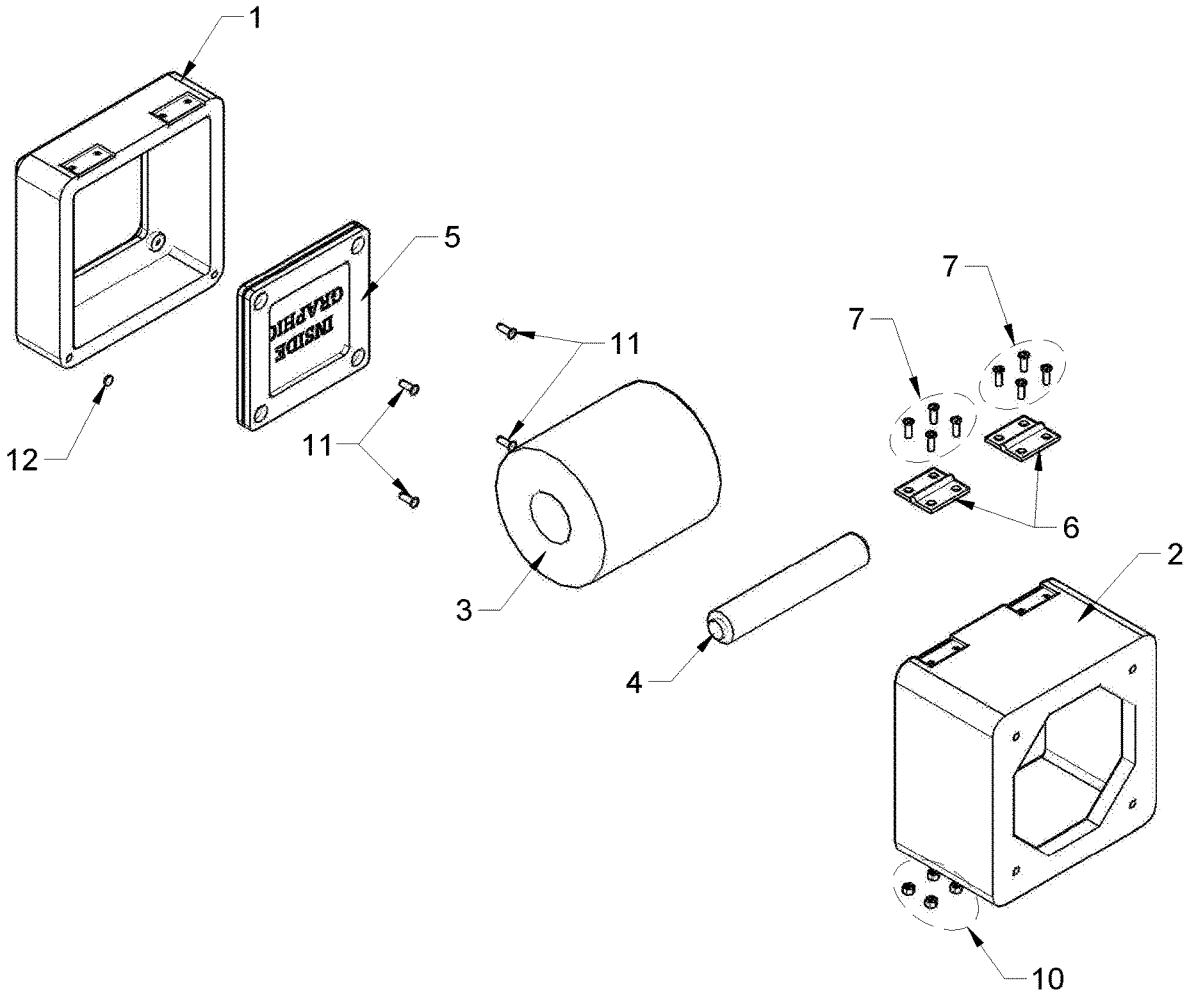
FIG. 8 is an upper right rear perspective view of the exploded invention.

1 Front Portion (Door)
2 Rear Portion (Base)
3 Toilet Paper Roll
4 Toilet Paper Spool
5 Door Insert Panel
6 Butt Hinge
7 Hinge Mounting Screw
8 Mounting Screw for Device to Vertical Wall
9 Vertical Wall Mounting Surface
10 Recessed Locking Nut for Hinge Mounting Screw
11 Mounting Screw for Door Insert Panel
12 Rubber Striker Pads

DESCRIPTION OF THE PREFERRED EMBODIMENT

With reference now to the drawings, and specifically to FIGS. 1 through 8 thereof, a new toilet paper dispenser embodying the principles and concepts of the present invention and generally designated by the reference numerals 1-12 will be described.

As best illustrated in FIGS. 1 through 8, the toilet paper dispenser (items 1-12) encloses a roll of toilet paper (item 3). The toilet paper (item 3) has sufficient strength to be selectively unrolled.

A housing has two main components, the front door component (item 1) and the rear base component (item 2) and each have a top wall, a bottom wall, a first side wall and a second side wall. The housing is divided into a front door component and a back base component along a vertical plane extending through the top and bottom walls. The top wall of the front door component (item 1) is pivotally coupled to the top wall of the back base component (item 2). The pivoting capabilities of the front door component (item 1) is facilitated by two metal hinges (item 6) attached to the top surfaces of the front door component and the rear base component (items 1 and 2). Each of these hinges is attached to the front door component and the rear base component using flush screws on the top (item 7) and recessed self-locking nuts (item 10). The self-locking nuts (item 10) are recessed enough so that they are flush with the lower surface of the upper walls of both the front door component and the rear base component.

Four supports (item 8) support the housing on a vertical wall. Each of the supports (item 8) includes a fastener which penetrates through a hole located in each of the four corners of the partial back wall of the rear base component (item 2) Each of a plurality of fasteners (item 8) extends through the corner of the partial back wall of the back base component (item 2) and into a vertical wall (item 9).

A spindle (item 4) is removably extended into a chamfered pocket located on each of the side walls of the rear base component (item 2). The spindle (item 4) extends through the roll of toilet paper (item 3) such that the toilet paper is rotatably positioned on the spindle. The spindle (item 4) is a conventional type used for dispensing toilet paper.

The front door component (item 1) has a separate panel (item 5) that is attached by four fasteners (item 11) that can be viewed by the user through a window in the front portion when in the down/closed position (see FIG. 1). The nominal text that is recommended for the inside graphic for the door insert panel (item 5) of this toilet paper dispenser is a warning that the device is "Not cat-proof when door is open!". When the front portion is in the up/open position, the warning that the toilet paper dispenser is not cat-proof can be seen by the user as the "inside graphic" (see FIG. 4). This panel (item 5) can be customized to display various graphics and/or text on both the inside and outside surfaces. The front door component (item 1) has two small rubber bumpers (item 12) that are fastened to the lower corners of the door component and are located between the front door component (item 1) and the rear base component (item 2).

In use, the toilet paper dispenser is used as a conventional toilet paper dispenser when the front door unit (item 1) is in the upper/open position, but when the front door component (item 1) is in the down/closed position (see FIG. 1), the housing provides complete protection of the toilet paper from being damaged and/or unrolled by cats.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

ADVANTAGES

It is therefore an object of the present invention to provide a new toilet paper dispenser apparatus and method which has many of the advantages of the toilet paper dispensers mentioned heretofore and many novel features that result in a new toilet paper dispenser which is not anticipated, rendered obvious, suggested, or even implied by any of the prior art toilet paper dispensers, either alone or in any combination thereof.

1. This new type of toilet paper holder/dispenser provides full protection from unwinding and damage by cats.
2. This new type of toilet paper holder/dispenser provides a warning notification to the user, when the door component is in the upward/open position that the holder/dispenser is not cat-proof when the door is open.
3. When the door component is in the down/closed position, there is a convenient horizontal surface on the top of the holder/dispenser to lay things on.
4. The door component has a removable face-plate that can be customized with various graphics and or text messages on both sides.
5. This new type of toilet paper holder/dispenser has recessed fasteners for both hinges that eliminate snags of toilet paper on them.
6. This new type of toilet paper dispenser may be easily and efficiently manufactured and marketed.
7. This new type of toilet paper dispenser is made of a durable and reliable construction.
8. This new type of toilet paper dispenser is susceptible of a low cost of manufacture regarding both materials and labor, and which accordingly is then susceptible of low prices of sale to the consuming public, thereby making such toilet paper dispenser economically available to the buying public.
9. This new type of toilet paper dispenser provides protection of the toilet paper from damage and/or unwinding by cats.
10. This new type of toilet paper dispenser provides a convenient flat surface on top of the unit in order to provide a place to set small objects.
11. This new type of toilet paper dispenser provides a warning statement to the user that the unit is not cat-proof when the door is open.

Other advantages of one or more aspects will be apparent from a consideration of the drawings and ensuing description.

I claim:

1. A toilet paper dispensing system for attaching to a vertical wall, said system comprising: a housing which has a front door component, and a rear base component, and each of the said front door and rear base components has a first side wall, a second side wall, a top wall and a bottom wall, the said top walls are pivotally coupled together by two hinges allowing the front door component to be rotated upwards 180 degrees from a closed position to an open position;

four fasteners penetrate through four holes, with one of said four holes in each corner of a partial back wall of the rear base component to support the housing on the vertical wall, where each of the fasteners is a screw located in said respective corner of the partial back wall of the rear base component, with each screw attached to the vertical wall;

the front door component having a partial front wall with a square opening where a removable door insert panel is configured to be viewed, with the front door component having at least two soft rubber bumpers located in lower corners which touch the rear base component that soften an impact when the front door component is closed quickly;

a roll of toilet paper, said toilet paper configured to be selectively unrolled;

a spindle being removably extended into each of said first and second side walls of said rear base component, said spindle extending through said roll of toilet paper such that said toilet paper is rotatably positioned on said spindle and said spindle is removably extended into two chamfered pockets each located in the first and second side walls of the rear base component, and said spindle extends through the roll of toilet paper and supports the roll and allows it to rotate freely.

2. The toilet paper dispensing system as described in claim 1, wherein the plurality of the said fasteners penetrates the said partial back wall of the rear base component, extending through the said partial back wall of the said rear base component and into said vertical wall.

3. The toilet paper dispensing system as described in claim 1, wherein said front door component has the door insert panel, which can be customized with wording or graphics and is removably attached to said square opening by four fasteners, said door insert panel configured to be seen through the square opening in the said partial front wall of the said front door component.

4. The toilet paper dispensing system as described in claim 1, while said front door component is in the open position, warning language stating that the toilet paper dispensing system is: "Not cat-proof when door is open!" is configured to be seen by a user and when the front door component is in the closed position, the toilet paper dispensing system provides protection of the roll of toilet paper from being seen/damaged/unrolled by cats while, at the same time, provides a convenient horizontal area that is configured to be utilized by the user on a top of the holder.

5. The toilet paper dispensing system as described in claim 1, wherein said two hinges utilize fasteners that have screw heads that are flush with an exterior surface of the hinges and said hinges also utilize countersunk self-locking nuts that are countersunk so that an exposed face is flush with interior mounting surfaces of the housing, and these said fasteners are utilized to remove the possibility of snagging toilet paper on these fasteners while the system is in use, and the fasteners are used to secure the two hinges to have exterior surfaces that are flush with top side exterior surfaces of the front door component and the rear base component.

* * * * *